US007273830B2

(12) United States Patent
Isaac et al.

(10) Patent No.: US 7,273,830 B2
(45) **Date of Patent: *Sep. 25, 2007**

(54) THERMAL DONOR FOR HIGH-SPEED PRINTING

(75) Inventors: Walter H. Isaac, Penfield, NY (US); Christine J. Landry-Coltrain, Fairport, NY (US); David M. Teegarden, Pittsford, NY (US); Dennis J. Massa, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 27 days.

This patent is subject to a terminal disclaimer.

(21) Appl. No.: 11/017,070

(22) Filed: Dec. 20, 2004

(65) Prior Publication Data

US 2006/0135362 A1 Jun. 22, 2006

(51) Int. Cl.
*B41M 5/035* (2006.01)

(52) U.S. Cl. ..... 503/227

(58) Field of Classification Search ..... 503/227
See application file for complete search history.

(56) References Cited

U.S. PATENT DOCUMENTS

| | | | |
|---|---|---|---|
| 5,100,861 | A | 3/1992 | Gemmell et al. |
| 5,256,622 | A | 10/1993 | Henzel |
| 5,565,406 | A | 10/1996 | Slark et al. |
| 6,063,842 | A | 5/2000 | Kwon et al. |
| 2003/0113518 | A1 | 6/2003 | DeYoung et al. |
| 2004/0219313 | A1 | 11/2004 | Ieshige et al. |

FOREIGN PATENT DOCUMENTS

| | | | |
|---|---|---|---|
| JP | 02-151485 | * | 6/1990 |
| JP | 08034170 | A | 2/1996 |

* cited by examiner

*Primary Examiner*—B. Hamilton Hess
(74) *Attorney, Agent, or Firm*—Kathleen Neuner Manne; Lynne M. Blank

(57) ABSTRACT

A dye-donor element, a method of printing using the dye-donor element, and a print assembly including the dye-donor element are described, wherein the dye-donor layer of the dye-donor element includes hydroxyalkyl cellulose as a binder. The dye-donor element is capable of printing a defect-free image on a receiver element at a line speed of 2.0 msec/line or less while maintaining a print density of at least 2.0.

18 Claims, No Drawings

THERMAL DONOR FOR HIGH-SPEED PRINTING

CROSS REFERENCE TO RELATED APPLICATIONS

Cross-reference is made to related co-filed applications, U.S. application Ser. No. 11/017,487 to Landry-Coltrain et al., Ser. No. 11/017,590 to Massa et al., and Ser. No 11/017,377 to Teegarden et al.

FIELD OF THE INVENTION

A method of thermal printing at fast print speeds using a dye-donor element including a dye-donor layer having a binder of hydroxyalkyl cellulose is disclosed.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce cyan, magenta, and yellow electrical signals. These signals can be transmitted to a thermal printer. To obtain a print, a black, cyan, magenta, or yellow dye-donor layer, for example, can be placed face-to-face with a dye image-receiving layer of a receiver element to form a print assembly, which can be inserted between a thermal print head and a platen roller. A thermal print head can be used to apply heat from the back of the dye-donor sheet. The thermal print head can be heated up sequentially in response to the black, cyan, magenta, or yellow signals. The process can be repeated as needed to print all colors, and a laminate or protective layer, as desired. A color hard copy corresponding to the original picture can be obtained. Further details of this process and an apparatus for carrying it out are contained in U.S. Pat. No. 4,621,271 to Brownstein.

Thermal transfer works by transmitting heat through the donor from the back-side to the dye-donor layer. When the dyes in the dye-donor layer are heated sufficiently, they sublime or diffuse, transferring to the adjacent dye-receiving layer of the receiver element. The density of the dye forming the image on the receiver can be affected by the amount of dye transferred, which in turn is affected by the amount of dye in the dye layer, the heat the dye layer attains, and the length of time for which the heat is maintained at any given spot on the donor layer.

At high printing speeds, considered to be 2.0 msec/line or less, the print head undergoes heat on/off cycles very rapidly. This generated heat must be driven through the dye-donor support assemblage very rapidly to effect the dye transfer from the donor to the receiver. Each layer in the donor can act as an insulator, slowing down the heat transfer through the layers of the donor to the receiver. Because of the short heat application time, any reduction in heat transfer efficiency results in a lower effective temperature in the donor layer during printing, which can result in a lower transferred dye density. It is known to overcome the low print density associated with shorter line times by increasing the print-head voltage, increasing the dye density in the dye-donor layer, or a combination thereof. Applying higher print head voltages can decrease the lifetime of the thermal print head, and requires a higher power supply, both of which increase cost. Increasing the dye density in the dye-donor layer increases costs, as well as increasing the chance of unwanted dye transfer, such as during storage of a dye-donor element.

Another problem exists with many of the dye-donor elements and receiver elements used in thermal dye transfer systems. At the high temperatures used for thermal dye transfer, many polymers used in these elements can soften and adhere to each other, resulting in sticking and tearing of the donor and receiver elements upon separation from one another after printing. Areas of the dye-donor layer other than the transferred dye can adhere to the dye image-receiving layer, causing print defects ranging from microscopic spots to sticking of the entire dye-donor layer on the receiver. This is aggravated when higher printing voltages, resulting in higher temperatures, are used in high speed printing. Another problem with high speed printing is that the more rapid physical motion of the donor/receiver assembly results in higher peel rates between the donor element and the receiver element as they are separated after printing, which can aggravate sticking of the donor and receiver.

U.S. Pat. No. 5,256,622, describes the use of several high viscosity polymers as binders in the dye-donor layer. U.S. Pat. No. 5,256,622 teaches that both hydroxypropylcellulose and cellulose acetate proprionate (CAP) are equally adequate as dye-donor layer binders, as long as their intrinsic viscosity is at least 1.6. The print speeds exemplified are much slower than currently desired print speeds, which can be 2 msec per line or less. Under the slower print speeds (typically 4 msec per line or greater), both hydroxypropylcellulose and CAP perform well as dye-donor layer binders.

There is a need in the art for a means of increasing print speed while 1) maintaining or increasing print density, such as by increased dye transfer efficiency, 2) maintaining or reducing power to the print head, and 3) reducing or eliminating donor-receiver sticking.

SUMMARY OF THE INVENTION

A method of printing is disclosed, wherein the method comprises obtaining a donor comprising a support and a dye layer, wherein the dye layer comprises a binder and a dye patch, the binder comprising hydroxyalkyl cellulose; obtaining a receiver having a support and a dye-receiving layer on the support; placing the dye layer of the donor adjacent the dye-receiving layer of the receiver; and applying heat in an imagewise fashion to the donor to form a dye image on the receiver, wherein the image is formed at a line speed of 2 msec or less.

ADVANTAGES

A dye-donor element and method of printing using the same are provided, wherein the dye-donor element enables fast printing while maintaining or increasing print density, maintaining or reducing power to the print head, and reducing or eliminating donor-receiver sticking.

DETAILED DESCRIPTION OF THE INVENTION

A dye-donor element having a binder including hydroxyalkyl cellulose, a printing assembly including the dye-donor element and a receiver element, and a method of printing using the dye-donor element are presented.

As used herein, "sticking" refers to adherence of a dye-donor element to a receiver element. Sticking can be detected by resultant defects in the dye-donor element or receiver element. For example, sticking can cause a removal of dye from the dye-donor element, appearing as a clear spot on the dye-donor element, or an over-abundance of dye on the receiver element. Sticking also can cause an uneven or spotty appearance on the dye-donor element. "Gross sticking" is when the dye-donor layer of the dye-donor element is pulled off of a support layer and sticks to the receiver element. This can appear as uneven and randomized spots across the dye-donor element and receiver element. "Microsticking" results in an undesirable image where a small area of the dye-donor element and receiver element stick together. Microsticking can be observed with a magnifying glass or microscope.

"Defect-free" or "defect-free image" as used herein refer to a printed image having no indication of donor-receiver sticking as defined herein, and having no areas of dye-dropout in the image, wherein dye-dropout is defined as the absence of transfer of dye to the receiver element, or insufficient transfer of the dye to the receiver element, on a pixel by pixel basis.

"Number of steps with sticking" as used herein means the number of squares in a printed image of a density step tablet that had defects as defined above due to donor-receiver sticking. The density step tablet image, having rectangular image fields of decreasing image density from $D_{max}$ to $D_{min}$, can be printed with a print assembly as described herein. As used herein, a "print" refers to formation of an image on a receiver element using at least one dye patch on the dye-donor element. As used herein, $D_{max}$ refers to the highest Status A reflection density that can be obtained using the print assembly under the specified print conditions, and $D_{min}$ refers to the density obtained when no dye is transferred to the receiver.

The dye-donor element can include a dye-donor layer. The dye-donor layer can include one or more colored areas (patches) containing dyes suitable for thermal printing. As used herein, a "dye" can be one or more dye, pigment, colorant, or a combination thereof, and can optionally be in a binder or carrier as known to practitioners in the art. During thermal printing, at least a portion of one or more colored areas can be imagewise or patch transferred to the receiver element, forming a colored image on the receiver element. The dye-donor layer can include a laminate area (patch) having no dye. The laminate area can follow one or more colored areas. During thermal printing, the entire laminate area can be transferred to the receiver element. The dye-donor layer can include one or more colored areas and one or more laminate areas. For example, the dye-donor layer can include three color patches, for example, yellow, magenta, and cyan, and a clear laminate patch, for forming a full color image with a protective laminate layer on a receiver element.

Any dye transferable by heat can be used in the dye-donor layer of the dye-donor element. The dye can be selected by taking into consideration hue, lightfastness, and solubility of the dye in the dye donor layer binder and the dye image receiving layer binder. Examples of suitable dyes can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include:

C.I. (color index) Disperse Yellow 51, 3, 54, 79, 60, 23, 7, and 141;

C.I. Disperse Blue 24, 56, 14, 301, 334, 165, 19, 72, 87, 287, 154, 26, and 354;

C.I. Disperse Red 135, 146, 59, 1, 73, 60, and 167;

C.I. Disperse Orange 149;

C.I. Disperse Violet 4, 13, 26, 36, 56, and 31;

C.I. Disperse Yellow 56, 14, 16, 29, 201 and 231;

C.I. Solvent Blue 70, 35, 63, 36, 50, 49, 111, 105, 97, and 11;

C.I. Solvent Red 135, 81, 18, 25, 19, 23, 24, 143, 146, and 182;

C.I. Solvent Violet 13;

C.I. Solvent Black 3;

C.I. Solvent Yellow 93; and

C.I. Solvent Green 3.

Further examples of sublimable or diffusible dyes that can be used include anthraquinone dyes, such as Sumikalon Violet RS® (product of Sumitomo Chemical Co., Ltd.), Dianix Fast Violet 3R-FS® (product of Mitsubishi Chemical Corporation.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5 GH® (product of Mitsui Toatsu Chemicals, Inc.); direct dyes such as Direct Dark Green B® (product of Mitsubishi Chemical Corporation) and Direct Brown M® and Direct Fast Black D® (products of Nippon Kayaku Co. Ltd.); acid dyes such as Kayanol Milling Cyanine 5R® (product of Nippon Kayaku Co. Ltd.); and basic dyes such as Sumicacryl Blue 6G® (product of Sumitomo Chemical Co., Ltd.), and Aizen Malachite Green® (product of Hodogaya Chemical Co., Ltd.); magenta dyes of the structures

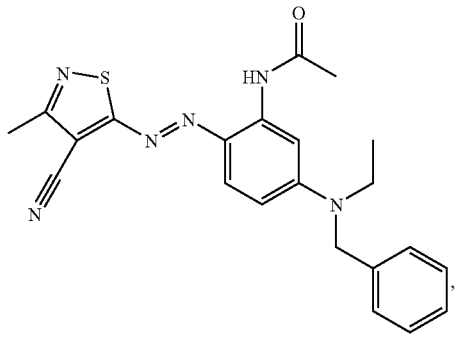

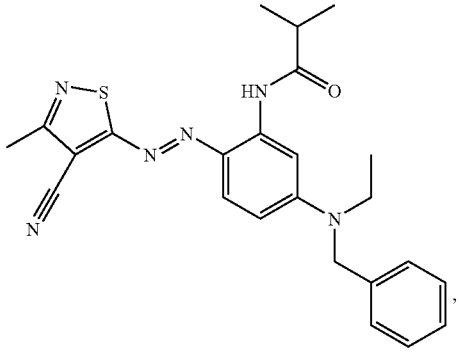

-continued

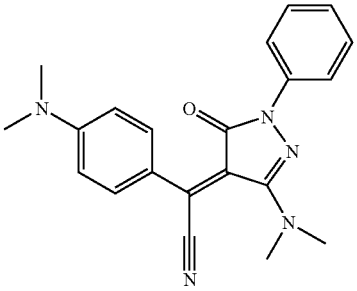

; and cyan dyes of the structures

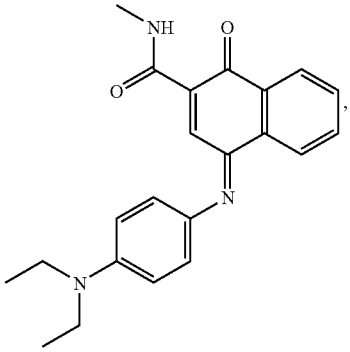

,

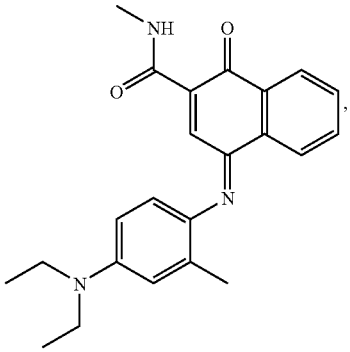

,

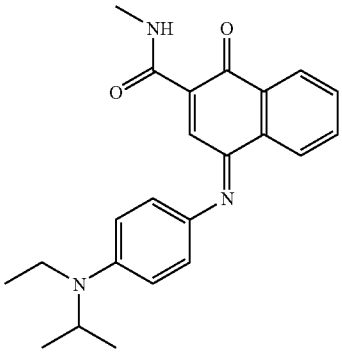

, and

-continued

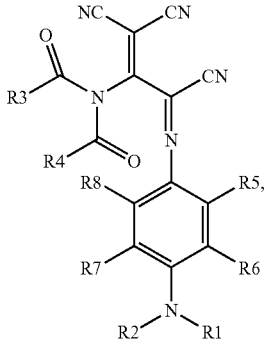

where R1 and R2 each independently represents an alkyl group, a cycloalkyl group, an aryl group, a heterocyclic group, or R1 and R2 together represent the necessary atoms to close a heterocyclic ring, or R1 and/or R2 together with R6 and/or R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or R5 and R6 together and/or R7 and R8 together represent the necessary atoms to close one or more heterocyclic ring fused on the benzene ring, or R6 and/or R7 together with R1 and/or R2 represent the necessary atoms to close a heterocyclic ring fused on the benzene ring; and R9 represents an alkyl group, a cycloalkyl group, an aryl group and a heterocyclic group; and yellow dyes of the structures

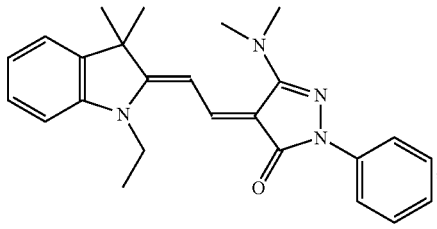

, and

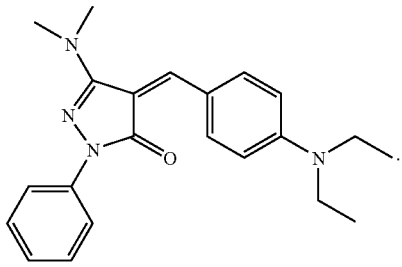

.

Further examples of useful dyes can be found in U.S. Pat. Nos. 4,541,830; 5,026,677; 5,101,035; 5,142,089; 5,804,531; and 6,265,345, and U.S. Patent Application Publication No. US 20030181331. Suitable cyan dyes can include Kayaset Blue 714 (Solvent Blue 63, manufactured by Nippon Kayaku Co., Ltd.), Phorone Brilliant Blue S-R (Disperse Blue 354, manufactured by Sandoz K. K.), and Waxoline AP-FW (Solvent Blue 36, manufactured by ICI). Suitable magenta dyes can include MS Red G (Disperse Red 60, manufactured by Mitsui Toatsu Chemicals, Inc.), and Macrolex Violet R (Disperse Violet 26, manufactured by Bayer). Suitable yellow dyes can include Phorone Brilliant Yellow S-6 GL (Disperse Yellow 231, manufactured by Sandoz K. K.) and Macrolex Yellow 6G (Disperse Yellow 201, manufactured by Bayer). The dyes can be employed singly or in combination to obtain a monochrome dye-donor layer or a black dye-donor layer. The dyes can be used in an amount of from 0.05 $g/m^2$ to 1 $g/m^2$ of coverage. According to various embodiments, the dyes can be hydrophobic.

Each dye-donor layer patch can range from 20 wt. % to 90 wt. % dye, relative to the total dry weight of all components in the layer. A high amount of dye is desirable for increased efficiency, but higher amounts of dye can lead to increased occurrences of donor/receiver sticking. Depending on the efficiency of the dye-donor layer, a lower amount of dye can be used to achieve the same efficiency as a different dye-donor layer. The dye percent is ideally chosen in view of the specific donor and receiver combination. Varying the amount of dye in the donor can aid in matching the efficiency between different dye patches, for example, a cyan, magenta, and yellow patch. For example, yellow and/or magenta patch dye amounts can be between 20 wt. % and 75 wt. % dye relative to the total dry weight of all components in the layer, for example, between 30 wt. % and 50 wt. %. A cyan patch dye amount can be between 40 wt. % and 90 wt. % dye relative to the total dry weight of all components in the layer, for example, between 55 wt. % and 75 wt. %.

To form a dye-donor layer, one or more dyes can be dispersed in a polymeric binder including hydroxyalkyl cellulose. The hydroxyalkyl cellulose can be, for example, hydroxypropyl cellulose, methylhydroxypropyl cellulose, hydroxypropylmethyl cellulose, or a combination thereof. According to certain embodiments, the binder can be hydroxypropyl cellulose. Hydroxypropylcellulose is sold under various trade names, such as, but not limited to, Klucel™ (Hercules Incorporated). Hydroxypropylcellulose is available in several grades classified by manufacturers according to their molar substitution and solution viscosity. A hydroxyalkyl cellulose suitable for use herein can have a solution viscosity of between 2 and 200 centipoise, for example, between 10 and 150 centipoise, as measured by 5 wt. % polymer dissolved in a solvent mixture containing 40 wt. % toluene and 60 wt. % 2-propanol measured at 21.5° C. with a Brookfield viscometer using a #18 spindle and rotating at 30 revolutions per minute.

The total amount of hydroxyalkyl cellulose in the binder can be greater than 40% by weight, for example, greater than 50%, greater than 60%, greater than 70%, greater than 80%, greater than 90% or greater than 95% by weight. For example, the binder can include primarily hydroxyalkyl cellulose, such that the total amount of hydroxyalkyl cellulose is at least 85% by weight, for example, 90%, 95%, or 98% or greater by weight.

The dye-donor layer of the dye-donor element can be formed or coated on a support. The dye-donor layer composition can be dissolved in a solvent for coating purposes. The dye-donor layer can be formed or coated on the support by techniques such as, but not limited to, a gravure process, spin-coating, solvent-coating, extrusion coating, or other methods known to practitioners in the art.

The support can be formed of any material capable of withstanding the heat of thermal printing. According to various embodiments, the support can be dimensionally stable during printing. Suitable materials can include polyesters, for example, poly(ethylene terephthalate) and poly (ethylene naphthalate); polyamides; polycarbonates; glassine paper; condenser paper; cellulose esters, for example, cellulose acetate; fluorine polymers, for example, poly(vinylidene fluoride), and poly(tetrafluoroethylene-co-hexafluoropropylene); polyethers, for example, polyoxymethylene; polyacetals; polyolefins, for example, polystyrene, polyethylene, polypropylene, and methylpentane polymers; polyimides, for example, polyimide-amides and polyetherimides; and combinations thereof. The support can have a thickness of from 1 μm to 30 μm, for example, from 3 μm to 7 μm.

According to various embodiments, a subbing layer, for example, an adhesive or tie layer, a dye-barrier layer, or a combination thereof, can be coated between the support and the dye-donor layer. The subbing layer can be one or more layers. The adhesive or tie layer can adhere the dye-donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities.

The dye-donor element can also include a slip layer to reduce or prevent print head sticking to the dye-donor element. The slip layer can be coated on a side of the support opposite the dye-donor layer. The slip layer can include a lubricating material, for example, a surface-active agent, a liquid lubricant, a solid lubricant, or mixtures thereof, with or without a polymeric binder. Suitable lubricating materials can include oils or semi-crystalline organic solids that melt below 100° C., for example, poly(vinyl stearate), beeswax, perfluorinated alkyl ester polyether, poly(caprolactone), carbowax, polyethylene homopolymer, or poly(ethylene glycol). The lubricating material can also be a silicone- or siloxane-containing polymer. Suitable polymers can include graft co-polymers, block polymers, co-polymers, and polymer blends or mixtures. Suitable polymeric binders for the slip layer can include poly(vinyl alcohol-co-vinylbutyral), poly(vinyl alcohol-co-vinylacetal), poly(styrene), poly(vinyl acetate), cellulose acetate butyrate, cellulose acetate, ethyl cellulose, and other binders as known to practitioners in the art. The amount of lubricating material used in the slip layer is dependent, at least in part, upon the type of lubricating material, but can be in the range of from 0.001 to 2 $g/m^2$, although less or more lubricating material can be used as needed. If a polymeric binder is used, the lubricating material can be present in a range of 0.1 to 50 weight %, preferably 0.5 to 40 weight %, of the polymeric binder.

The dye-donor element can include a stick preventative agent to reduce or eliminate sticking between the dye-donor element and the receiver element during printing. The stick preventative agent can be present in any layer of the dye-donor element, so long as the stick preventative agent is capable of diffusing through the layers of the dye-donor element to the dye-donor layer, or transferring from the slip layer to the dye-donor layer. For example, the stick preventative agent can be present in one or more patches of the dye-donor layer, in the support, in an adhesive layer, in a dye-barrier layer, in a slip layer, or in a combination thereof. According to various embodiments, the stick preventative agent can be in the slip layer, the dye-donor layer, or both.

According to various embodiments, the stick preventative agent is in the dye-donor layer. The stick preventative agent can be in one or more colored patches of the dye-donor layer, or a combination thereof. If more than one dye patch is present in the dye-donor layer, the stick preventative agent can be present in the last patch of the dye-donor layer to be printed, typically the cyan layer. However, the dye patches can be in any order. For example, if repeating patches of cyan, magenta, and yellow are used in the dye-donor element, in that respective order, the yellow patches, as the last patches printed in each series, can include the stick preventative agent. The stick preventative agent can be a silicone- or siloxane-containing polymer. Suitable polymers can include graft co-polymers, block polymers, co-polymers, and polymer blends or mixtures. Suitable stick preventative agents are described, for example, in commonly assigned U.S. application Ser. No. 10/667,065 to David G. Foster, et al., and Ser. No. 10/729,567 to Teh-Ming Kung, et al.

Optionally, release agents as known to practitioners in the art can also be added to the dye-donor element, for example, to the dye-donor layer, the slip layer, or both. Suitable release agents can include, for example, those described in U.S. Pat. Nos. 4,740,496 and 5,763,358.

According to various embodiments, the dye-donor layer can contain no plasticizer. Inclusion of the plasticizer in the dye-donor layer can increase dye-donor efficiency. The dye-donor layer can include plasticizers known in the art, such as those described in U.S. Pat. Nos. 5,830,824 and 5,750,465, and references disclosed therein. Suitable plasticizers can include compounds having a glass transition temperature ($T_g$) less than 25° C., a melting point ($T_m$) less than 25° C., or both. Plasticizers useful for this invention can include low molecular weight plasticizers and higher molecular weight plasticizers such as oligomeric or polymeric plasticizers. Examples of suitable plasticizers can include aliphatic polyesters, epoxidized oils, chlorinated hydrocarbons, poly(ethylene glycols), poly(propylene glycols), and poly(vinyl ethyl ether) (PVEE). The molecular weight of the plasticizer can be greater than or equal to 450 to minimize transfer of the plasticizer to the dye receiving layer during printing. Transfer of some plasticizers to the dye receiving layer can result in image keeping and stability problems. The plasticizer can be present in an amount of from 1 to 50%, for example, from 5% to 35%, by weight of the binder.

Aliphatic polyesters suitable as plasticizers can be derived from succinic acid, glutaric acid, adipic acid, pimelic acid, suberic acid, azelaic acid, and sebacic acid. Suitable aliphatic polyesters can have one or more functional end groups, for example a carboxyl, hydroxyl, or alkoxyl group, where each alkoxyl group can be from 1 to 18 carbon atoms. Examples of aliphatic polyesters that can be used in the invention include Drapex plasticizers (Crompton/Witco Corporation, Middlebury, Conn., USA), such as Drapex 429, Admex plasticizers (Velsicol Chemical Corporation, Rosemont, Ill., USA) such as Admex 429, and Paraplex G25, Plasthall HA7A, Plasthall P650, Plasthall P-7092, all from CP Hall Company, Chicago, Ill., USA.

Epoxidized oils suitable as plasticizers can include partially or completely epoxidized natural oils, and partially or completely epoxidized derivatized natural oils such as epoxidized soybean oil sold as Paraplex G-60, Paraplex G-62, and Plasthall ESO; epoxidized linseed oil sold as Plasthall ELO; or epoxidized octyl tallate sold as Plasthall S-73, all from C. P. Hall Company.

Chlorinated hydrocarbons suitable for use as plasticizers can include long-chain hydrocarbons or paraffins consisting of methylene, methyl, methane, or alkene groups, any of which can have a chlorine substitution. The length of the long-chain hydrocarbon can be between 8 and 30 carbon atoms, for example, between 12 and 24 carbon atoms. The chains can be branched. The amount of chlorine in the paraffin can be between 25 and 75 wt %, for example, between 40 and 70 wt %. Mixtures of chlorinated paraffins can also be used. According to certain embodiments, the chlorinated paraffins can have the formula $C_xH_yCl_z$ wherein x is between 11 and 24, y is between 14 and 43, and z is between 3 and 10. Examples of suitable chlorinated hydrocarbons can include Chlorowax liquids sold by Occidental Chemical Corp., Dallas, Tex., USA, and Paroil paraffins sold by Dover Chemical Corp., Dover, Ohio, USA, such as Chlorowax 40 and Paroil 170HV.

Poly(ethylene glycols) and poly(propylene glycols) suitable for use as plasticizers can have unsubstituted end groups (OH), or they can be substituted with one or more functional groups such as an alkoxyl group or fatty acid, where each alkoxyl group or fatty acid can be from 1 to 18 carbon atoms. Examples of suitable poly(ethylene glycols) and poly(propylene glycols) can include TegMer 809 poly (ethylene glycol) from C. P. Hall Co., and PPG #483 poly(propylene glycol) from Scientific Polymer Products, Ontario, N.Y., USA.

The dye-donor layer can include beads. The beads can have a particle size of from 0.5 to 20 microns, preferably from 2.0 to 15 microns. The beads can act as spacer beads under the compression force of a wound up dye-donor roll, improving raw stock keeping of the dye-donor roll by reducing the material transferred from the dye-donor layer to the slipping layer, as measured by the change in sensitometry under accelerated aging conditions, or the appearance of unwanted dye in the laminate layer, or from the backside of the dye-donor element, for example, a slipping layer, to the dye-donor layer. The use of the beads can result in reduced mottle and improved image quality. The beads can be employed in any amount effective for the intended purpose. In general, good results have been obtained at a coverage of from 0.003 to 0.20 g/m$^2$. Beads suitable for the dye-donor layer can also be used in the slip layer.

The beads in the dye-donor layer can be crosslinked, elastomeric beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethyl hexyl-, 2-chloroethyl-, 4-chlorobutyl- or 2-ethoxyethyl-acrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis (oxyethyl) dimethacrylate; 1,4-cyclohexylene-bis(oxypropyl)diacrylate; 1,4-cyclohexylene-bis(oxypropyl) dimethacrylate; and ethylene glycol dimethacrylate. The elastomeric beads can have from 1 to 40%, for example, from 5 to 40%, by weight of a crosslinking agent.

The beads in the dye-donor layer can be hard polymeric beads. Suitable beads can include divinylbenzene beads, beads of polystyrene crosslinked with at least 20 wt. % divinylbenzene, and beads of poly(methyl methacrylate) crosslinked with at least 20 wt. % divinylbenzene, ethylene glycol dimethacrylate, 1,4-cyclohexylene-bis(oxyethyl)

dimethacrylate, 1,4-cyclohexylene-bis(oxypropyl) dimethacrylate, or other crosslinking monomers known to those familiar with the art.

The dye-donor element can be a sheet of one or more colored patches or laminate, or a continuous roll or ribbon. The continuous roll or ribbon can include one patch of a monochromatic color or laminate, or can have alternating areas of different patches, for example, one or more dye patches of cyan, magenta, yellow, or black, one or more laminate patches, or a combination thereof.

The receiver element suitable for use with the dye-donor element described herein can be any receiver element as known to practitioners in the art. For example, the receiver element can include a support having thereon a dye image-receiving layer. The support can be a transparent film. Transparent supports include cellulose derivatives, for example, a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; poly(vinyl alcohol-co-vinylacetal); polyolefins, such as polyethylene or polypropylene; polysulfones; polyacrylates; polyetherimides; and mixtures thereof. Opaque supports include plain paper, coated paper, synthetic paper, photographic paper support, melt-extrusion-coated paper, and laminated paper, such as biaxially oriented support laminates. Biaxially oriented support laminates suitable for use as receivers are described in U.S. Pat. Nos. 5,853,965; 5,866,282; 5,874,205; 5,888,643; 5,888,681; 5,888,683; and 5,888,714. Biaxially oriented supports can include a paper base and a biaxially oriented polyolefin sheet, for example, polypropylene, laminated to one or both sides of a paper base. The support can be a reflective paper, for example, baryta-coated paper, white polyester (polyester with white pigment incorporated therein), an ivory paper, a condenser paper, or a synthetic paper, for example, DuPont Tyvek® by E.I. DuPont de Nemours and Company, Wilmington, Del. The support can be employed at any desired thickness, for example, from 10 μm to 1000 μm. Exemplary supports for the dye image-receiving layer are disclosed in commonly assigned U.S. Pat. Nos. 5,244,861 and 5,928,990, and in EP-A-0671281. Other suitable supports as known to practitioners in the art can also be used. According to various embodiments, the support can be a composite or laminate structure comprising a base layer and one or more additional layers. The base layer can comprise more than one material, for example, a combination of one or more of a microvoided layer, a nonvoided layer, a synthetic paper, a natural paper, and a polymer.

The dye image-receiving layer of the receiver element can be, for example, a polycarbonate, a polyurethane, a polyester, polyvinyl chloride, poly(styrene-co-acrylonitrile), poly (caprolactone), polyvinylacetals such as polyvinylbutyral or polyvinylheptal, poly(vinyl chloride-co-vinyl acetate), poly (ethylene-co-vinyl acetate), methacrylates including those described in U.S. Pat. No. 6,362,131, or combinations thereof. The dye image-receiving layer can be coated on the receiver element support in any amount effective for the intended purpose of receiving the dye from the dye-donor layer of the dye-donor element. For example, the dye image-receiving layer can be coated in an amount of from 1 $g/m^2$ to 5 $g/m^2$.

Additional polymeric layers can be present between the support and the dye image-receiving layer. The additional layers can provide coloring, adhesion, antistat properties, act as a dye-barrier, act as a dye mordant layer, or a combination thereof. For example, a polyolefin such as polyethylene or polypropylene can be present. White pigments such as titanium dioxide, zinc oxide, and the like can be added to the polymeric layer to provide reflectivity. A subbing layer optionally can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965,241. An antistatic layer as known to practitioners in the art can also be used in the receiver element. The receiver element can also include a backing layer. Suitable examples of backing layers include those disclosed in U.S. Pat. Nos. 5,011,814 and 5,096,875.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286.

The receiver element can also include stick preventative agents, as described for the donor element. According to various embodiments, the receiver element and dye-donor element can include the same stick preventative agent.

The dye image-receiving layer can be formed on the support by any method known to practitioners in the art, including but not limited to printing, solution coating, dip coating, and extrusion coating. Wherein the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element.

The dye-donor element and receiver element, when placed in superimposed relationship such that the dye-donor layer of the dye-donor element is adjacent the dye image-receiving layer of the receiver element, can form a print assembly. An image can be formed by passing the print assembly past a print head, wherein the print head is located on the side of the dye-donor element opposite the receiver element. The print head can apply heat image-wise or patchwise to the dye-donor element, causing the dyes or laminate in the dye-donor layer to transfer to the dye image-receiving layer of the receiver element.

Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, a Rohm Thermal Head KE 2008-F3, a Shinko head (TH300U162P-001), and Toshiba heads (TPH162R1 and TPH207R1A).

Use of the dye-donor element including an hydroxyalkyl cellulose binder as described herein allows high-speed printing of the print assembly, wherein high speed printing refers to printing at a line speed of 2.0 msec/line or less, for example, 1.5 msec/line or less, 1.2 msec/line or less, 1.0 msec/line or less, or 0.5 msec/line or less. Use of hydroxyalkyl cellulose as a binder can produce a defect-free image with a resultant print density greater than or equal to 2.0.

As described herein, all cellulosic polymers do not perform equally at fast printing speeds because they do not transfer the sufficient amounts of dye from the donor to the receiver element to achieve high image densities. The dye transfer efficiency from the donor to the receiver is much increased when the binder of the dye-donor layer includes hydroxyalkyl cellulose. Use of hydroxyalkyl cellulose as a binder enables fast printing while maintaining or increasing print density, maintaining or reducing power to the print head, and reducing or eliminating donor-receiver sticking. Examples are herein provided to further illustrate the invention.

EXAMPLES

Hydroxypropylcellulose used in the examples is referred to herein as "HPC" and was Klucel hydroxypropylcellulose, industrial grade E, a cellulose ether with a molar substitution of 3.8, obtained from Hercules Chemical, USA. The following cellulose ester polymers were obtained from Eastman Chemical Company, Kingsport, Tenn.: CAP-482-20 cellulose acetate propionate with 2.5% acetyl, 46.0% propionyl, and 1.8% hydroxyl; CAB-500-5 cellulose acetate butyrate with 4% acetyl, 51% butyryl, and 1.0% hydroxyl; and CAB-381-20 cellulose acetate butyrate with 13.5% acetyl, 37% butyryl, and 1.8% hydroxyl. Butvar B76 is a polyvinyl butyral manufactured by Solutia Incorporated, St. Louis, Mo., with 88% butyral, 1% acetate, and 11% hydroxyl.

Example 1

Dye-Donor Element I-1

A dye-donor element was prepared by coating the following layers in the order recited on a first side of a 4.5 micron poly(ethylene terephthalate) support:

(1) a subbing layer of a titanium alkoxide (Tyzor TBT® from E.I. DuPont de Nemours and Company) (0.16 g/m$^2$) from n-propyl acetate and n-butyl alcohol solvent mixture, and (2) a dye-donor layer containing the cyan dyes illustrated below in the following amounts: cyan dye #1 at 0.093 g/m$^2$, cyan dye #2 at 0.084 g/m$^2$, and cyan dye #3 at 0.21 g/m$^2$; HPC at 0.22 g/m$^2$; and divinyl benzene beads at 0.0084 g/m$^2$ coated from a solvent mixture of 50 wt. % toluene and 50 wt. % 1-butanol.

cyan dye #1

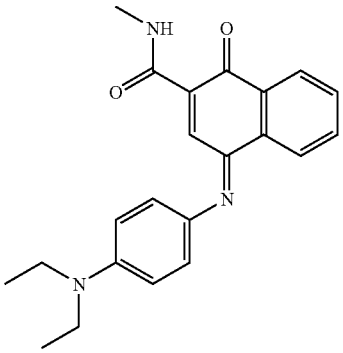

-continued cyan dye #2

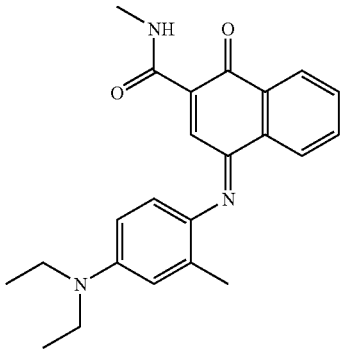

cyan dye #3

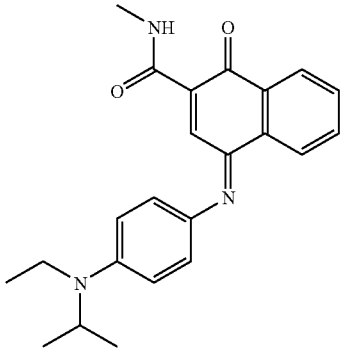

On a second side of the support, a slipping layer was prepared by coating the following layers in the order recited:

(1) a subbing layer of a titanium alkoxide (Tyzor TBT® (0.16 g/m$^2$) from n-propyl acetate and n-butyl alcohol solvent mixture, and (2) a slipping layer containing an ethene polymer of Polywax 400® (0.02 g/m$^2$), a polyalphaolefin of Vybar 103® (0.02 g/m$^2$), and a maleic anhydride copolymer of Ceremer 1608 (0.02 g/m$^2$), all from Baker-Petrolite Polymers, Sugar Land, Tex., and a poly(vinyl acetal) binder (0.41 g/m$^2$) (Sekisui KS-1) coated from a solvent mixture of 75 wt. % toluene, 20 wt. % methanol, and 5 wt. % cyclopentanone.

Receivers

Receivers as shown below were prepared, having an overall thickness of about 220 μm and a thermal dye receiver layer thickness of about 3 μm. R-1 was prepared by solvent coating the subbing layer and dye receiving layer onto a prepared paper support. R-2 was prepared by melt extruding the tie layer and dye receiving layer onto a prepared paper support.

| R-1 |
|---|
| 4-8 μm divinyl benzene beads and solvent coated cross-linked polyol dye receiving layer |
| Subbing layer |
| Microvoided composite film OPPalyte 350 K18 (ExxonMobil) |
| Pigmented polyethylene |
| Cellulose Paper |
| Polyethylene |
| Polypropylene film |
| R-2 |
| Co-extruded polyester-polycarbonate-silicone dye receiving layer |

-continued

| |
|---|
| Pelestat 300 (Sanyo Chemical Industries, Ltd.) tie layer |
| Microvoided composite film OPPalyte 350 K18 (ExxonMobil) |
| Pigmented polyethylene |
| Cellulose Paper |
| Polyethylene |
| Polypropylene film |

Dye-Donor Elements I-2 and I-3 and Comparative Elements C-1 Through C-4

Dye-donor elements I-2 and I-3 were prepared the same as dye donor element I-1 except that the solvent composition used for the I-2 dye patch was 40 wt. % toluene with 60 wt. % 2-propanol for donor element I-2, and the solvent composition used for the I-3 dye patch was 50 wt. % toluene, 40 wt. % 2-propanol, and 10 wt. % cyclopentanone. Dye-Donor Comparative Elements C-1 through C-4 were prepared the same as dye-donor element I-1, except that the hydroxypropylcellulose in the dye-donor layer was replaced by the polymers listed in Table 1, and the dye solutions were coated out of a solvent mixture of 70 wt. % toluene, 25 wt. % methanol, and 5 wt. % cylcopentanone.

Procedure

An 11-step patch image of optical density (OD) ranging from $D_{min}$ (OD<0.2) to $D_{max}$ (OD>2.0) was printed for donor-receiver sensitometry and sticking performance evaluation. When printed using 0.52 msec/line and a resistive head voltage of 25.4 V, this is equivalent to equal energy increments ranging from a print energy of 0 Joules/cm$^2$ to a print energy of 0.653 Joules/cm$^2$. When printed using 0.52 msec/line and a resistive head voltage of 32 V, this is equivalent to equal energy increments ranging from a print energy of 0 Joules/cm$^2$ to a print energy of 1.037 Joules/cm$^2$. Printing was done manually as described below.

The dye side of the dye-donor element was placed in contact with the dye image-receiving layer of the receiver element R-1 of the same width to form a print assembly. The print assembly was fastened to a stepper motor driven pulling device. The imaging electronics were activated, causing the pulling device to draw the print assembly between the print head and a roller at a rate of about 163 mm/sec, resulting in a printing line time of 0.52 msec/line. The voltage supplied to the resistive print head was constant for a given print. Two prints were made, one at 25.4 volts and one at 32 volts. The maximum print head voltage that could be applied without damaging the print head was 32 V. After each print, the dye-donor element and receiver element were separated manually and the Status A red reflection density of each printed step of the 11-step patch image on the receiver was measured using an X-Rite Transmission/Reflection Densitometer (model 820; X-Rite Incorporated). The values of the red density at the two different print energies of 0.653 and 1.037 J/cm$^2$ obtained when printing each dye-donor element to receiver R-1 are reported in Table 1.

TABLE 1

| Element | Polymer | Density at 0.653 J/cm$^2$ | Density at 1.037 J/cm$^2$ |
|---|---|---|---|
| I-1 | HPC | 1.46 | 2.26 |
| I-2 | HPC | 1.38 | 2.24 |
| I-3 | HPC | 1.15 | 2.13 |
| C-1 | CAP 482-20 | 0.82 | 1.94 |

TABLE 1-continued

| Element | Polymer | Density at 0.653 J/cm$^2$ | Density at 1.037 J/cm$^2$ |
|---|---|---|---|
| C-2 | Cellulose acetate butyrate (CAB381-20) | 0.88 | 1.96 |
| C-3 | Cellulose acetate butyrate (CAB500-5) | 1.01 | 1.99 |
| C-4 | polyvinylbutyral (Butvar B76) | 0.90 | 1.89 |

The above results show that when hydroxypropylcellulose is used as the binder in the cyan dye donor layer, higher optical print densities can be obtained for the same input energy than what can be obtained when other polymers are used as the binder in the dye donor layer, particularly at higher print energies. This advantage is critical when printing at faster speeds.

Example 2

Dye-Donor Element I-4

A dye-donor element was prepared the same as dye-donor element I-1 except that the dye-donor layer contained the magenta dyes illustrated below as follows: Magenta dye #1 at 0.0700 g/m$^2$, Magenta dye #2 at 0.0642 g/m$^2$, and Magenta dye #3 at 0.1462 g/m$^2$, HPC at 0.2967 g/m$^2$, and 2 micron divinyl benzene beads at 0.0054 g/m$^2$ coated from a solvent mixture of 75 wt. % toluene, 20 wt. % methanol and 5 wt. % cyclopentanone.

Magenta dye #1

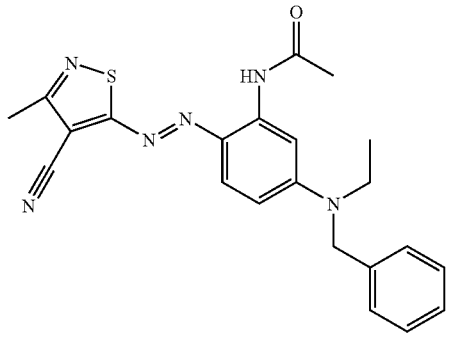

Magenta dye #2

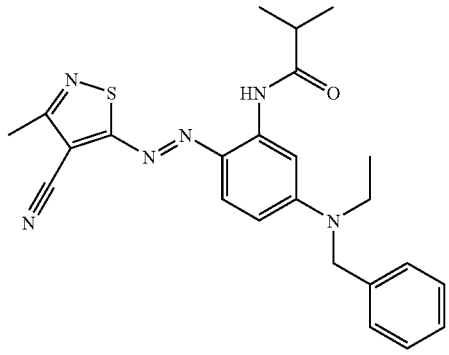

-continued

Magenta dye #3

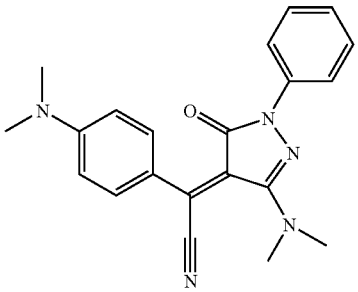

Dye-Donor Elements I-5 Through 1-6 and Comparative Element C-5

Dye-donor elements I-5 through I-6 were prepared the same as dye-donor element I-3, except that the solvents used to prepare the HPC coating solutions was changed as listed in Table 2. For comparative dye-donor element C-5, CAP-482-20 was used in place of HPC, coated from a solvent composition as listed in Table 2.

Procedure

Dye-donor elements I-4 through I-6 and Control element C-5 were printed to receiver R-1 the same as for dye-donor element I-1. The print densities were measured the same as for dye-donor element I-1, except that the Status A green reflection density of each printed step of the 11-step patch image was measured using an X-Rite Transmission/Reflection Densitometer (model 820; X-Rite Incorporated). The values of the green density at the two different print energies of 0.653 and 1.037 J/cm$^2$ obtained when printing each dye-donor element to receiver R-1 are reported in Table 2.

TABLE 2

| Element | Binder | Density at 0.653 J/cm$^2$ | Density at 1.037 J/cm$^2$ | Coating Solvents |
|---|---|---|---|---|
| I-4 | HPC | 1.09 | 2.48 | 50:50 toluene, 1-methoxy-2-propanol |
| I-5 | HPC | 1.22 | 2.39 | 50:50 toluene, ethanol |
| I-6 | HPC | 1.34 | 2.32 | 50:50 Toluene, 2-propanol |
| C-5 | CAP 482-20 | 0.77 | 2.07 | 75:20:5 Toluene, Methanol, cyclopentanone |

The above results show that when HPC is used as the binder in the magenta dye donor layer, higher optical print densities can be obtained for the same input energy than what can be obtained when other polymers are used as the binder in the dye donor layer. This advantage is critical when printing at faster speeds.

Example 3

Dye-Donor Element I-7

A dye-donor element was prepared the same as dye-donor element I-1 except that the dye-donor layer contained the yellow dyes illustrated below as follows: Yellow dye #1 at 0.0785 g/m$^2$ and Yellow dye #2 at 0.0978 g/m$^2$, HPC at 0.2283 g/m$^2$, and 2 micron divinyl benzene beads at 0.0037 g/m$^2$ coated from a solvent mixture of 50 wt. % toluene and 50 wt. % 1-butanol.

Yellow dye #1

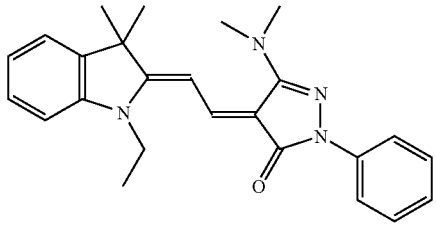

Yellow Dye #2

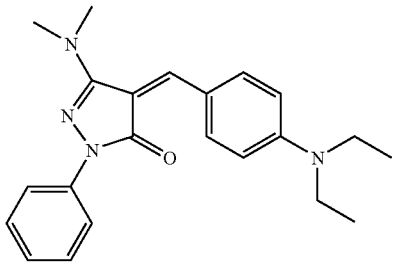

Dye-Donor Comparative Element C-6

Yellow Dye-Donor Comparative Element C-6 was prepared the same as dye-donor element I-7, except that the HPC in the dye-donor layer was replaced by CAP-482-20 coated from solvent mixture of 75 wt. % toluene, 20 wt. % methanol and 5 wt. % cyclopentanone.

Procedure

Dye-donor element I-7 and Control element C-6 were printed to receiver R-1 the same as for dye-donor element I-1. The print densities were measured the same as for dye-donor element I-1, except that the Status A blue reflection densities of the Dmax step of the 11-step patch image was measured using an X-Rite Transmission/Reflection Densitometer (model 820; X-Rite Incorporated).

The Status A red and green reflection densities of elements I-1 and C-1, and I-4 and C-5, respectively, were measured as previously described. The minimum print head voltages required to produce cyan, magenta, and yellow monochrome densities of 2.1 or greater under fast print conditions (0.52 msec/line) and slow print conditions (5.0 msec/line) are reported in Table 3.

TABLE 3

| Element | Color | Voltage at 5.0 msec/line | Voltage at 0.52 msec/line |
|---|---|---|---|
| I-1 | Cyan | 13.85 | 30.88 |
| I-4 | Magenta | 13.87 | 30.12 |
| I-7 | Yellow | 13.41 | 29.28 |
| C-1 | Cyan | 15.00 | Could not reach D ≧ 2.1 |
| C-5 | Magenta | 14.52 | 31.60 |
| C-6 | Yellow | 14.74 | 31.91 |

The above results show that at slow print times, hydroxypropylcellulose provides little advantage over CAP as binder in the dye donor layer. At fast print times, acceptable cyan patch print densities can not be obtained when using CAP as the dye-donor layer binder without exceeding a voltage that would damage the print head, whereas they can be obtained when using hydroxypropylcellulose as the dye-donor layer binder.

Example 4

Dye-Donor Comparative Element C-7

Dye-Donor Comparative Element C-7 was prepared the same as dye-donor comparative element C-1, except that an additional 0.0169 g/m$^2$ of a plasticizer Paraplex G25 from The C. P. Hall Company, Chicago, Ill., was added to the dye-donor layer.

Procedure

Dye-donor elements I-1 through I-3 and dye-donor comparative elements C-1, C-2, C-3 and C-7 were printed the same as in Example 1 but with receiver R-2, and the printed images were examined for donor-receiver sticking. The examination was done by visual examination of the receiver. Donor-receiver sticking was identified by the presence of defects on the receiver, for example, the presence of unwanted dye transferred to the receiver element; the presence of dye layer stuck to the receiver, and uneven and randomized spots across the receiver element. The number of steps in the 11-step patch in a monochrome cyan print that showed sticking to receiver R-2 is recorded for each sample in Table 4.

TABLE 4

| | Binder | Solvents | # steps stuck |
|---|---|---|---|
| I-1 | HPC | 50:50 toluene, 1-butanol | 3 |
| I-2 | HPC | 40:60 toluene, 2-propanol | 2 |
| I-3 | HPC | 50:40:10 toluene, 2-propanol, cyclopentanone | 3 (edge only) |
| C-1 | CAP 482-20 no G25 | 70:25:5 toluene, methanol, cyclopentanone | 6 |
| C-2 | CAB 381-20 | 70:25:5 toluene, methanol, cyclopentanone | 6 |
| C-3 | CAB 500-5 | 70:25:5 toluene, methanol, cyclopentanone | 7 |
| C-7 | CAP 482-20 with G25 | 70:25:5 toluene, methanol, cyclopentanone | 6 |

The above results show that HPC, when used as the dye-donor layer binder, has much improved performance over other binders such as CAP and CAB cellulose ester polymers. Sample I-3 printed with receiver R-2 showed some slight sticking only on the very edge of the image. All the other samples with sticking showed sticking across the entire step.

The invention has been described in detail with particular reference to certain preferred embodiments thereof, but it will be understood that variations and modifications can be effected within the spirit and scope of the invention.

The invention claimed is:

1. A method of printing, comprising obtaining a donor comprising a support and a dye layer, wherein the dye layer comprises a binder and a dye, the binder comprising hydroxyalkyl cellulose;

obtaining a receiver having a support and a dye-receiving layer on the support;

placing the dye layer of the donor adjacent the dye-receiving layer of the receiver; and applying heat in an imagewise fashion to the donor to form a dye image on the receiver, wherein the image is formed at a line speed of 2 msec or less.

2. The method of claim 1, wherein the image is formed at a line speed of 1.5 msec or less.

3. The method of claim 1, wherein the image is formed at a line speed of 1.2 msec or less.

4. The method of claim 1, wherein the image has a maximum density of at least 2.

5. The method of claim 1, wherein the receiver is formed by extruding the dye-receiving layer onto the support.

6. The method of claim 1, wherein the hydroxyalkyl cellulose is hydroxypropyl cellulose, methylhydroxypropyl cellulose, hydroxypropylmethyl cellulose, or a combination thereof.

7. The method of claim 1, wherein the hydroxyalkyl cellulose is hydroxypropyl cellulose.

8. The method of claim 1, wherein the dye layer does not include a plasticizer.

9. The method of claim 1, wherein the dye layer includes a plasticizer.

10. The method of claim 9, wherein the plasticizer is an aliphatic polyester, an epoxidized oil, a chlorinated hydrocarbon, a poly(ethylene glycol), a poly(propylene glycol), a poly(vinyl ethyl ether), or a combination thereof.

11. The method of claim 9, wherein the plasticizer is a polyester adipate, a polyester sebacate, poly(propylene glycol), or polyester glutarate.

12. The method of claim 9, wherein the plasticizer is present in an amount from 1 wt. % to 35 wt. % by weight of the binder.

13. The method of claim 1, wherein the binder comprises greater than 40% by weight hydroxyalkyl cellulose.

14. The method of claim 1, wherein the binder comprises greater than 60% by weight hydroxyalkyl cellulose.

15. The method of claim 1, wherein the binder comprises greater than 80% by weight hydroxyalkyl cellulose.

16. A print assembly comprising a donor and a receiver, wherein the donor comprises a support and a dye layer, wherein the dye layer comprises a binder and a dye, the binder comprises hydroxyalkyl cellulose, and wherein said print assembly is printed at a line speed of 2 msec or less.

17. The print assembly of claim 16, wherein the receiver comprises a support and an extruded dye-receiving layer on the support.

18. The print assembly of claim 16, wherein the hydroxyalkyl cellulose is hydroxypropyl cellulose, methylhydroxypropyl cellulose, hydroxypropylmethyl cellulose, or a combination thereof.

* * * * *